United States Patent [19]

Bender et al.

[11] Patent Number: 4,630,325

[45] Date of Patent: Dec. 23, 1986

[54] METHOD OF AN APPARATUS FOR LASTING SIDES OF SHOES ON LASTS, COMPRISING A SIDE TACK INSERTION DEVICE

[75] Inventors: Rudolf Bender, Mucke-Ruppertenrod; Hans-Gerd Dietrich, Friedrichsdorf; Gerhard Giebel, Bad Soden, all of Fed. Rep. of Germany

[73] Assignee: USM Corporation, Farmington, Conn.

[21] Appl. No.: 842,759

[22] Filed: Mar. 21, 1986

Related U.S. Application Data

[63] Continuation of Ser. No. 603,508, Apr. 24, 1984.

[30] Foreign Application Priority Data

Apr. 25, 1983 [DE] Fed. Rep. of Germany ..... 3314906

[51] Int. Cl.[4] ..... A43D 21/12; A43D 23/02; A43D 21/00

[52] U.S. Cl. ..... 12/8.1; 12/12.1; 12/13.1

[58] Field of Search ..... 12/8.3, 8.6, 10.6, 10.7, 12/12, 12.1, 13.1, 8.1, 8.2, 11.2, 11.4

[56] References Cited

U.S. PATENT DOCUMENTS

| | | | |
|---|---|---|---|
| 1,517,297 | 12/1924 | Chapelle | 12/8.1 |
| 1,711,620 | 5/1929 | Tatro | 12/10.7 |
| 2,438,918 | 4/1948 | Kamborian | 12/8.3 |
| 2,449,122 | 9/1948 | Jorgensen | 12/8.1 |
| 2,655,672 | 10/1953 | Covrchene | 12/8.1 |
| 2,660,740 | 12/1953 | Robinson | 12/12.1 |
| 3,995,340 | 12/1976 | Becker | 12/8.1 |
| 4,296,513 | 10/1981 | Halford et al. | 12/12 |

FOREIGN PATENT DOCUMENTS

| | | | |
|---|---|---|---|
| 1959560 | 6/1971 | Fed. Rep. of Germany . | |
| 1685513 | 6/1975 | Fed. Rep. of Germany . | |
| 2459101 | 6/1976 | Fed. Rep. of Germany | 12/8.1 |
| 2848551 | 5/1980 | Fed. Rep. of Germany . | |

*Primary Examiner*—Werner H. Schroeder
*Assistant Examiner*—Steven N. Meyers
*Attorney, Agent, or Firm*—Spencer T. Smith

[57] ABSTRACT

Method of and apparatus for side lasting shoes on lasts comprising a side tack insertion device, wherein the latter is moved along the lasting margin in an operating path following the course of the shank region. A friction closure element (tensioning strap, roller, smoothing runner) is moved stepwise in a longitudinal direction of the shoe and with each step is pressed periodically against the upper in a strip-like region associated with each tack insertion, whereby the upper is stretched in a direction towards the lasting margin.

2 Claims, 13 Drawing Figures

67
69
44
68
43
14
10
11
13
19
18
17
15
55
60
59
31
66
47
58
62
65
61
63
64
50
49
57
46
51
48
52
9
5
44
43
2
28
1
8
45
B
B
3
4
3
26
2
28

75
73
79
14
10
11
13
19
18
17
15
31
66
32
50
62
65
61
63
64
78
77
9
76
75
73
5
C
C
2
28
8
74
3
4
3
26
2
28
1

METHOD OF AN APPARATUS FOR LASTING SIDES OF SHOES ON LASTS, COMPRISING A SIDE TACK INSERTION DEVICE

This is a continuation of co-pending application Ser. No. 603,508 filed on Apr. 24, 1984.

BACKGROUND OF THE INVENTION

1. Field of the Invention

The invention is concerned with a method and an apparatus for lasting sides of shoes on lasts, comprising a side tack insertion device, wherein this device is moved along the lasting margin of the shoe on an operating path which follows the course of the shank region.

2. Prior Art

One side tack insertion device which moves along such an operating path is known from German patent specification No. 2316335. The operation of this device presupposes that, before the tacks are driven in, the lasting margin of the shoe on its last is already drawn tightly over the insole and held in this position.

In the case of a further side tack insertion device, known from German patent specification No. 3031649, the upper is tensioned over the last, before the tacks are inserted, by a wiper combined with the tack insertion device urging the lasting margin over the insole and thus pressing it against the insole, while at the same time a corresponding drafting force is applied to the upper. This leads to the upper being stretched on the last.

It has now become apparent that the stretching effected by such a wiper is insufficient, especially when it is a question of especially smooth leather. In such a case the wiper cannot effect a sufficient drafting force on the lasting margin, and this is especially disadvantageous if only a relatively small lasting margin is available.

BRIEF SUMMARY OF THE INVENTION

The invention is based upon the object of improving the stretching of the upper necessary for the satisfactory operation of a side tack insertion device. In accordance with the invention this takes place in that a friction closure element is moved stepwise in the longitudinal direction of the shoe, presses against the upper in a periodic manner with each step in a strip-like region between topline and lasting margin, said region being directly associated with the corresponding tack insertion, and thus, starting from the region of the topline tensions the upper in the direction of the lasting margin 3.

The friction closure element periodically pressed against the shoe upper effects a stretching of the shoe upper in each individual case, with reference to each tack insertion region, in the form of a strip extending from the topline in the direction of the lasting margin, whereby repeatedly, together with the individual tack insertions, stretching of the upper takes place, more especially in sequence stepwise in the longitudinal direction of the shoe. In this way a stretching effect is especially intensively applied to the shoe upper, since this effect has to be concentrated only at each tack insertion region.

Suitably the friction closure element is moved stepwise synchronously with the insertion operation. In this case for each insertion operation the same relationships are achieved in respect of the stretching of the shoe upper.

It is further desirable that the insertion operation takes place during the application of pressure by the friction closure element. In this case the tack to be inserted is presented with an already stretched upper.

In order to avoid the upper, in the region of its topline, being drawn out of its position in relation to the last by the stretching thereof which is effected by the friction closure element, suitably the upper can be pressed against the last in the region of the topline by pressure cushions. In this case the pressure cushions ensure that, despite the stretching of the upper, the latter cannot move in the region of the topline.

In order to combine the effect of stretching the upper by means of the friction closure element with an especially firm pressing of the lasting margin on the insole, a wiper, which is combined with the side tack insertion device, can be periodically moved over the lasting margin synchronously with the actuation of the friction closure element. In this case two elements act together on the shoe upper, namely the friction closure element and the wiper, whereby an especially good stretching of the shoe upper is achieved. Furthermore, the wiper provides the advantage of taking care of a certain distribution of the folds in the region of the lasting margin.

In order that the lasting margin is not pressed by the wiper prematurely against the insole, suitably the start of the operation of the friction closure element is caused to take place in timed relation with that of the wiper. In this case firstly the operation of the friction closure element begins, said element stretching the shoe upper, whereupon then the wiper additionally stretches the lasting margin and presses it against the last.

In order to prevent a certain withdrawal of the shoe upper during the return movement of the friction closure element, this return movement is suitably so configured that the friction closure element is thus moved without pressure relative to the lasting margin. In this case the lasting margin is exposed to no return thrust, whereby any movement of the lasting margin and thus of the shoe upper because of the return movement of the friction closure element is avoided.

The apparatus for carrying out the aforedescribed method is suitably so formed that the friction closure element is constituted by a tensioning strap which can be tensioned between two mounting points and the two mounting points are secured in such a manner to a periodically actuated advancing mechanism associated with the side tack insertion device, that, upon application of pressure, the tensioning strap engages the shoe upper heightwise of the convex top of the last between topline and lasting margin, and the first mounting point lies above the lasting margin and the second mounting point below this top, the tensioning strap being secured on the first mounting point and being held yieldingly in the direction of the second mounting point.

By virtue of this form of the friction closure element, as it is periodically actuated, with each pressure on the shoe upper a strip-form region directly associated with each tack insertion arises, in which the shoe upper is stretched from the topline to the lasting margin substantially along the contour of a cross-sectional plane of the shoe, the yielding support of the tensioning strap in the direction of the second mounting point taking care of the fact that in each case the stretching effect takes place exclusively in a direction from the topline to the lasting margin.

It is known per se from German specification No. 2642200, as laid open to inspection, to produce a stretching of the shoe upper, in combination with securing of the lasting margin effected by sticking, by pressing a tensioning strap, which extends over the shank region and is thus relatively wide, laterally against the shank region of the shoe on its last, which band is held at its side lying above the lasting margin by a plurality of clamps, while on its opposite side it is looped around a rod, whereby a corresponding tensioning of the tensioning strap can be produced. This apparatus is however unsuited in combination with side lasting by means of a side tack insertion device, since in this latter case no room would be present for the tack insertion device. The clamps referred to would for example stand in the way of the tack insertion device. The known apparatus, furthermore, operates neither with a periodic actuation of the tensioning strap nor with any stepwise advancing movement thereof.

Suitably the apparatus is so formed that the tensioning strap is under spring tension at its side associated with the second mounting point. In this case the tensioning strap may consist of unstretchable material. Its yieldability then arises by virtue of the springs.

In the case of the use of a wiper, this is suitably associated with the advancing mechanism of the tensioning strap. In this case, upon movement of the tensioning strap in the longitudinal direction of the shoe, a corresponding movement of the wiper also takes place.

In this arrangement it is especially suitable to mount the first mounting point at the end of the wiper, whereby automatically with the actuation of the wiper a corresponding pressing movement of the tensioning band also takes place.

In order to avoid too high a pressure application of the tensioning band, using this arrangement, suitably the surface of the wiper which wipes over the lasting margin is provided with a groove which accommodates the tensioning strap. When the wiper engages the lasting margin the tensioning strap can then more or less disappear in the groove, while nevertheless, before the wiper engages the lasting margin, because of its tensioning it can apply its effect to the shoe upper.

BRIEF DESCRIPTION OF THE DRAWINGS

Exemplary embodiments of the invention are illustrated in the drawings.

DESCRIPTION OF THE PREFERRED EMBODIMENTS

Figure 1:
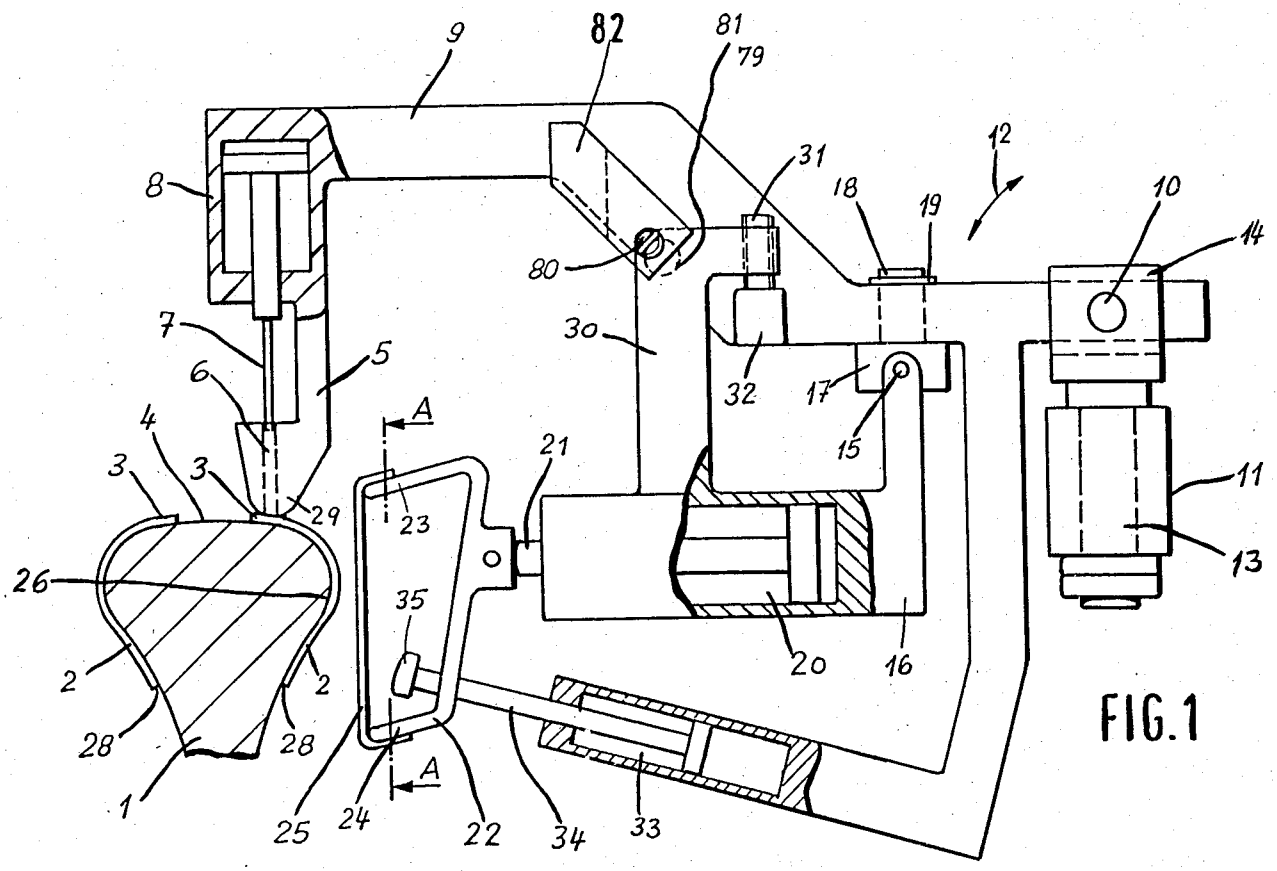
FIG. 1 shows the device with a tensioning strap constituting the friction closure element.

FIG. 1 shows the last 1 on which the shoe upper 2 is mounted, with its lasting margin 3 lying on the bottom 4 of the last 1 (for reasons of simplification of the drawing, an insole is not shown). The side tack insertion device 5 serves for the side lasting, individual tacks being supplied in known manner (not shown herein) into the insertion channel 6 of said device. The insertion of a tack into the lasting margin 3 then takes place, also in known manner, by means of the driver 7 which is actuated in known manner by means of the piston-and-cylinder unit 8. The piston-and-cylinder unit 8, together with the tack insertion device 5, is carried on the carrier arm 9 which is pivotally connected via the pin 10 to the frame 11. Attention should be drawn to the German patent specification Nos. 3031649 and 2316335, already mentioned in the introduction, with reference to further details of the mounting of the carrier arm 9. This mounting is not the subject of the present invention. It can therefore also be constructed differently, especially with reference to the further possibilities of movement of the carrier arm. The rotatability of the arm 9 about the pin 10, indicated by the double arrow 12, is completed by a further rotatability about the pin 13 carried by the frame 11, which pin 13 ends in the hinge element 14 through which the pin 10 passes. The pin 13 gives to the carrier arm 9 a rotatability by virtue of which the side tack insertion device 5 can be moved along the lasting margin 3. The holder 16 is connected to the carrier arm 9 via the pin 15, said pin 15 passing through the block 17 mounted on the carrier arm 9. The block 17 is carried on the pin 18, which is secured by means of the securing ring 19 in such a manner that it cannot slide through the carrier arm 9. The pin 18 gives to the holder 16 a rotatability concerning which further detail is inserted below. The carrier 16 contains a piston-and-cylinder unit 20 the piston rod 21 of which carries at its end the fork 22 which forms the two mounting points 23 and 24 for the tensioning strap 25. By advancing the piston rod 21, the tensioning strap 25 is moved in the direction of the last 1 until it touches the upper 2 heightwise of the convex top 26 of the last 1. In this arrangement the first mounting point 23 lies above the lasting margin 3 and the second mounting point 24 beneath the top 26.

The tensioning strap 25 consists of elastic material, its elasticity increasing in the direction of the second mounting point 24. In order to realize this, the tensioning band may consist of non-stretchable material in its region near the first mounting point 23 and of stretchable material in its region near the second mounting point 24. In this connection, it may be a question of e.g. a combination of textile material with adjacent rubber strap. One can also contemplate using the same materials throughout, e.g. rubber, but forming it with different thicknesses so that, in the region of the second mounting point 24 a greater stretchability arises up to about the middle of the tensioning band 25.

Figure 2:
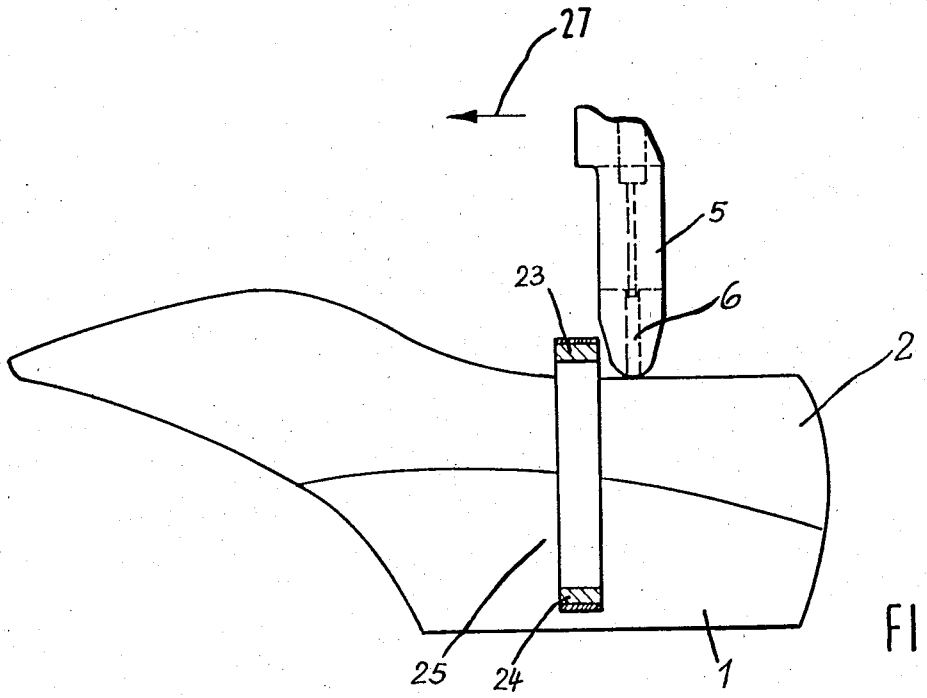
FIG. 2 shows a section along the line A—A of FIG. 1, the drawing being limited to the shoe on its last, the tensioning strap and the side tack insertion device.

In FIG. 2 the position of the tensioning strap 25 in relation to the last 1 is shown, indeed as a section along the line A—A of FIG. 1. The tensioning strap 25 extends over a relatively short distance in relation to the length of the last 1, approximately along a cross-section line of the last 1, and indeed immediately in front of the side tack insertion device 5 in the direction of movement of this insertion device along the last 1, so that the effect of the tensioning strap 25 can be applied to the upper 2 immediately before each insertion of a tack. The direction of advancing movement of the side tack insertion device 5, together with that of the tensioning strap 25, is indicated by the arrow 27 in FIG. 2. It should be noted that it is also possible to provide the reverse direction of advancing movement. In this case the tensioning strap 25 would be arranged on the other side of the side tack insertion device 5.

Figure 3:
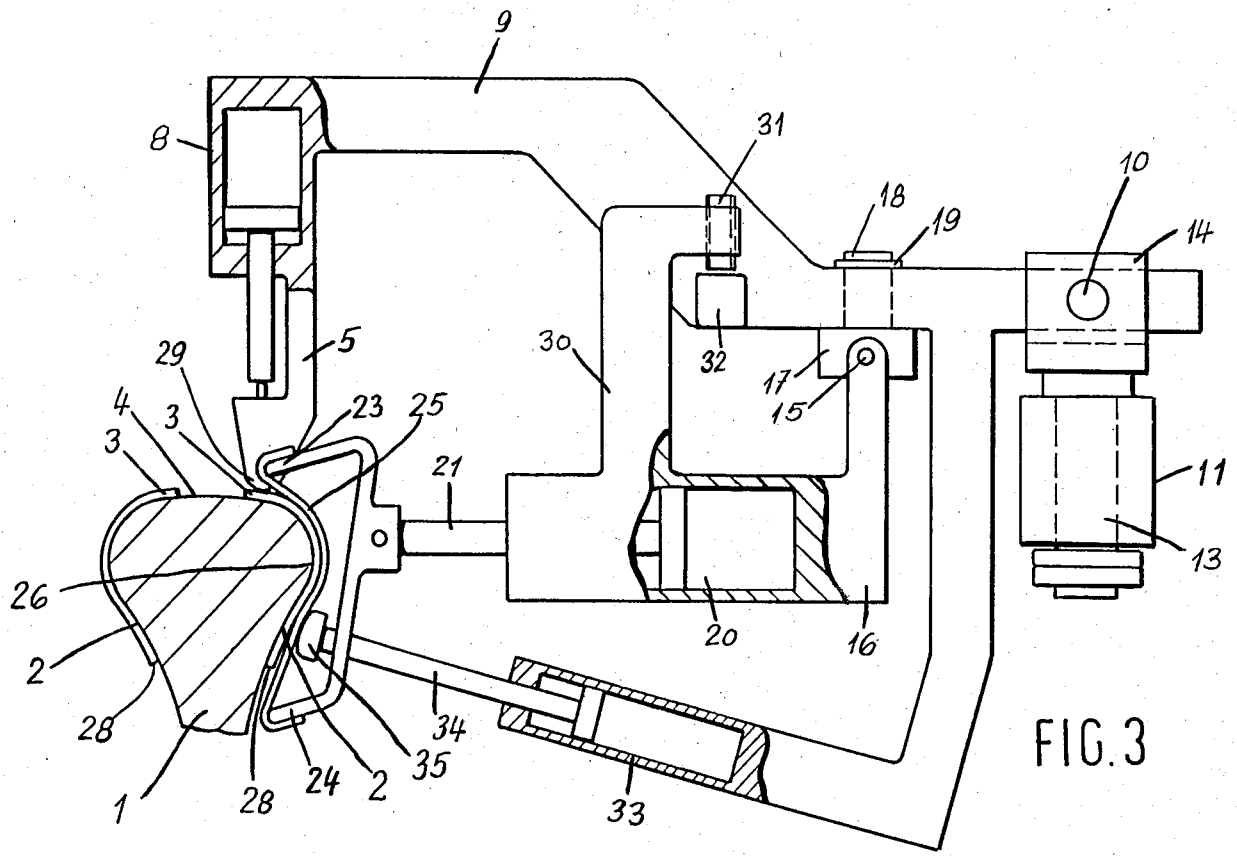
FIG. 3 shows the apparatus according to claim 1 with the tensioning strap applying pressure.

When the fork 22 is further advanced together with the tensioning strap 25, the latter finally assumes the position shown in FIG. 3. In this position the now stretched tensioning strap 25 lies about the upper 2 and presses it against the last 1 from the topline 28 to the lasting margin 3. In this movement, wherein the first mounting point 23 projects relatively far over the top 26 of the last 1, a drafting force is applied to the upper 2 especially over this top 26, which force leads to a stretching of the upper 2 on the last 1. In this position of the tensioning strap 25, the insertion of a tack takes place by corresponding actuation of the piston-and-cylinder unit 8. The tack to be driven in is presented with a stretched shoe upper 2, the lasting margin 3 being additionally pressed against the last 1 by the nozzle 29 of the side tack insertion device 5.

As already mentioned above, the holder 16 is connected to the carrier arm 9 via the pin 15. This mounting results because, when the fork 22 together with the tensioning strap 25 is advanced, and thus the first mounting point 23 thereby extends over the top 26 of the last 1, the holder 16 must likewise yield upwardly. This yieldability is provided for the holder 16 by the connection by means of the pin 15. In order now to give the holder 16 a defined position for the start of the advancing movement of the fork 22, (see FIG. 1), the holder 16 is provided with the angle 30 which holes the adjusting screw 31 which abuts against the projection 32 mounted on the carrier arm 9. In the case of the holder 16 being raised because of the pressure of the tensioning strap 25 against the upper 2, the adjusting shoe 31 is then raised from the projection 32. Upon retraction of the fork 22 together with the tensioning strap 25, the holder 10 then falls downwardly again until the adjusting screw 31 engages the projection 32 (see FIG. 1).

In order to move the side tack insertion device along its operating path (see arrow 27 in FIG. 2), is already mentioned above the carrier arm 9 is pivoted about the pin 13. The nozzle 29 of the tack insertion device 5 thus follows with extensive accuracy the course of the lasting margin 3. In this movement the fork 22 and the tensioning strap 25 are carried therewith by means of the holder 16. In order that no sliding movement of the tensioning strap 25 along the upper 2 takes place, and further in order that the insertion of the tacks in each case is presented with a stretched shoe upper 2, the tensioning strap 25 is periodically pressed against the shoe upper 2 and again moved away therefrom, the tensioning strap 25 thus effecting a periodic movement between the two extreme positions shown in FIGS. 1 and 3. Each time pressure is applied to the shoe upper 2 the tensioning strap 25 is brought into its position shown in FIG. 3, whereby renewed stretching of the shoe upper 2 takes place, so that it is exposed to a constantly repeating stretching effect as long as the side tack insertion device 5 is moved over the lasting margin 3. In this way, for each insertion operation of a tack an especially intensively stretched shoe upper 2 is thus presented.

The advancing of the carrier arm 9 can be caused to take place continually as well as advancing stepwise. Normally, because of the speed of the insertion operation, a continuous advance suffices. In this case necessarily, when the tensioning strap 25 applies pressure against the shoe upper 2, there arises in relation to the advance of the carrier arm 9 an arresting effect, which is compensated for by the pin 18. Thus, while the holder 16 does not change its position when the tensioning strap 25 is applying pressure, the carrier arm 9 can be moved further along the operating path, said arm 9 turning correspondently relative to the holder 16 by means of the pin 18. By means shown in FIGS. 1 and 1*a* the holder 16 is again rotated into its initial position when the tensioning strap 25 is withdrawn (see FIG. 1), and indeed by means of a spring 79 together with a stop screw 80, the spring acting between the angle 30 and the carrier arm 9.

Figure 1A:
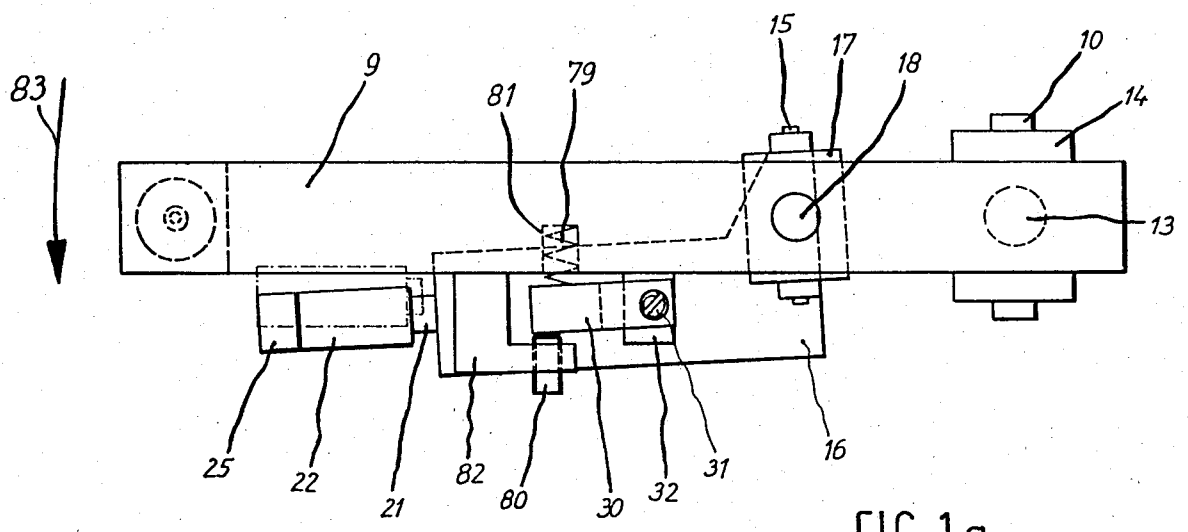

As is shown in FIGS. 1 and 1*a*, the rotation of the holder 16 about the pin 18 is limited by the angle 30, which projects from the holder 16, extending into the region between the stop screw 80 and the carrier arm 9. The angle 30 is here pressed against the stop screw 80 by the spring 79, which is inserted into the bore 81 in the carrier arm 9, and thus assumes its initial position. If then the carrier arm 9 is rotated, during its advance, about the pin 13 and thus the tensioning strap 25 and the holder 16 therewith are arrested each momentarily, the angle 30 is moved relatively away from the stop screw 80 in the direction of the carrier arm 9 until the tensioning strap 25 is again withdrawn from the shoe upper 2, whereupon, under the effect of the spring 79, the angle 30 is urged back into its initial position shown in FIG. 1*a*, in which initial position the angle 30 abuts against the stop screw 80. The play in the movement of the angle 30 between stop screw 80 and carrier arm 9 is thus so selected that the return of the tensioning strap 25 takes place before the angle 30 abuts against the carrier arm 9. The abutment screw 80 is inserted into the holder element 82 projecting from the carrier arm 9 and therefore always has a defined position in relation to the carrier arm 9. In FIG. 1*a* are indicated the extreme positions which arise during the rotary movement of the holder 16, and indeed the initial position is shown in full line and the position of greatest rotation of the holder 16 by chain-dot line, which lines reproduce the tensioning strap 25 and the fork 22. The rotation of the carrier arm 9 which thus takes place is indicated by the arrow 83.

It should be pointed out that, in the drawings illustrating the further exemplary embodiments, the mechanism explained above with reference to Fig. 1*a* has been omitted for reasons of clarity.

It is also possible to advance the carrier arm 9 stepwise from insertion to insertion. In this case the connection between the holder 16 and carrier arm 9 via the pin 18 can be dispensed with.

The pressing of the shoe upper 2 by means of the tensioning strap 25 takes place in each case simultaneously with the insertion of a tack, the apparatus being so controlled that first the application of pressure by means of the tensioning strap 25 takes place, whereupon, with the tensioning strap 25 applying pressure, the insertion of a tack takes place. In this case, a synchronism automatically arises with respect to the advancing movement of the side tack insertion device 5 and of the tensioning strap 25 in the longitudinal direction of the last 1, since each inserting has a pressure-applying operation and consequently, synchronously with the insertion operations, the tensioning strap 25 is synchronously moved.

In FIGS. 1 and 3 the piston-and-cylinder unit 33 secured to the carrier arm 9 is shown, the piston rod 34 thereof carrying the pressure cushion 35. The pressure cushion 35 serves to clamp the upper 2 in respect of the position of its topline 28 when pressure is applied to the upper 2 by the tensioning strap 25 against the last 1. This pressure cushion 35 is not necessary if no strong drafting force has to be applied by the tensioning strap 25 to the upper 2 and if the upper 2 has a firm seating on the last 1 by reason of a tight topline 28. The piston-and-cylinder unit 33 is actuated before the tensioning strap 25 stretches the last 2 (sic). For this purpose the pressure cushion 35 is advanced together with the tensioning strap 25 and applies pressure finally against the tensioning strap 25 which already lies against the upper 2, when the stretching effect has not yet been applied by the tensioning strap 25 in the region of the lasting margin 3. In order to give to the tensioning strap 25 the necessary stretchability in the region of the pressure cushion 35, the latter is formed of stretchable material between the second mounting point 24 and its region against the top 26 of the last 1. In the construction shown in FIGS. 1 and 2 the piston rod 34 projects through a passage in the fork 22. It is however also possible to provide the piston rod 34 with an angled portion embracing the fork 22, so that the pressure cushion 35 presses against the upper 2 substantially in the region of the tensioning strap 25. It is also possible to allow the pressure cushion 35 to press against the upper 2 directly adjacent the tensioning strap 25. However, the arresting effect is then correspondingly smaller. In this case, however, the tensioning strap 25 remains unaffected by the advancing movement of the pressure cushion 35.

Figure 4:
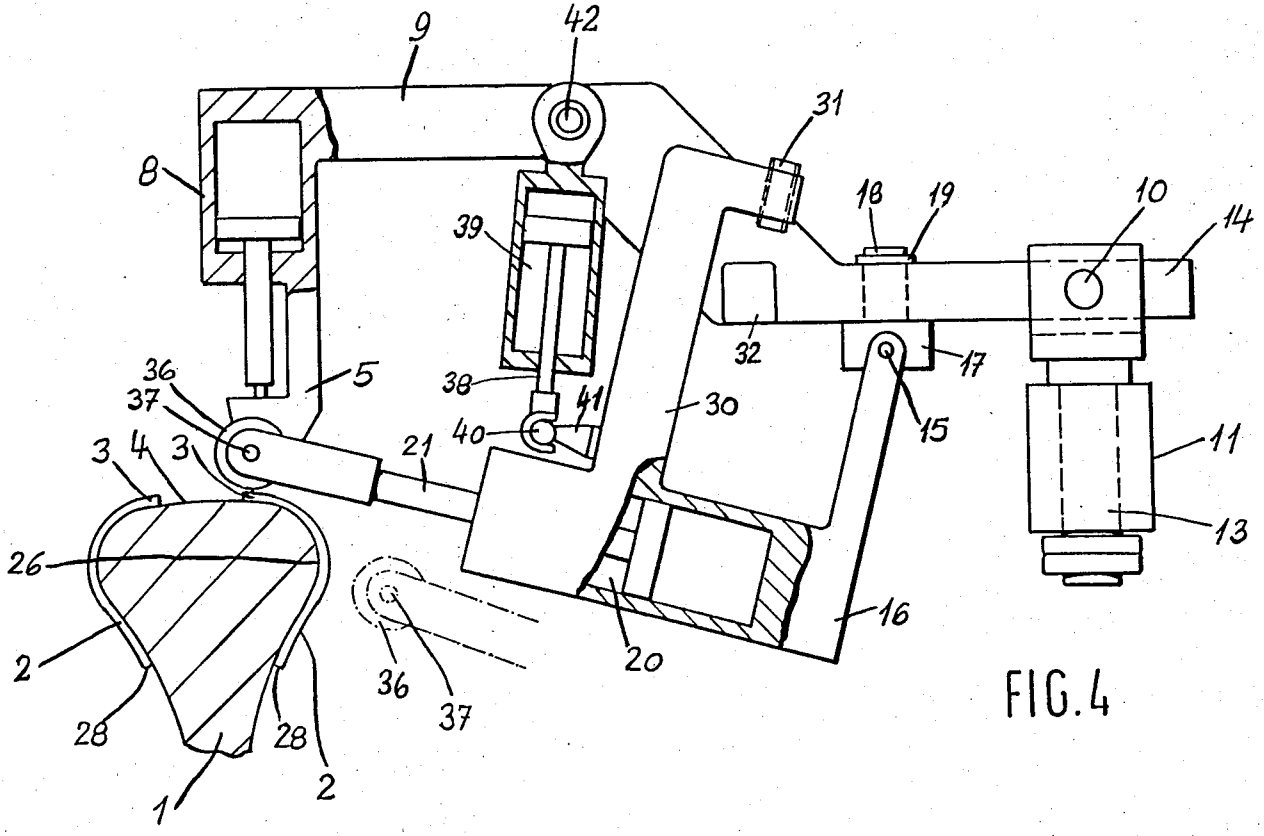
FIG. 4 shows the apparatus with a roller constituting the friction closure element.

In FIG. 4 is shown one embodiment of the apparatus, wherein, instead of a tensioning strap, the roller 36 is used as the friction closure element. The roller 36 is journalled at the end of the piston rod 21 for rotation about the pin 37. The apparatus shown in FIG. 4 operates substantially as the apparatus in accordance with FIGS. 1 and 3, so that reference can be made to the description of the (apparatus shown) in FIGS. 1 and 2 for explaining the function of the apparatus according to FIG. 4.

In FIG. 4 the roller 36 is shown in dotted line in its initial position, in which, with the piston rod 21 withdrawn, it is disposed in the vicinity of the top 26. The holder 16 is in this case additionally connected to the piston rod 38 of the piston-and-cylinder unit 39, and indeed via the ball joint 40, which is secured to the angle 30 by the pin 41, forming part of the holder 16. The piston-and-cylinder unit 39 is connected by the pin 42 to the carrier arm 9, at its side away from the ball joint 40.

The apparatus shown in FIG. 4 is so controlled that, at the beginning of the advancing movement of the roller 36, the piston-and-cylinder unit 39 is so actuated that the piston rod 38 thereby moves into the piston-and-cylinder unit 39, whereby the roller 36 is raised. Thus, it reaches the region above the top 26 and here engages the upper 2. With further advancing movement of the piston-and-cylinder unit 20 actuating the roller 36 the latter rolls away over the upper 2 until it finally reaches the end position shown in FIG. 4, in which it presses the lasting margin 3 against the last bottom 4. In order that, during this rolling movement of the roller 36 relative to the upper 2, the roller 36 can apply the requisite pressure to the upper 2, especially in the region of the lasting margin, the piston-and-cylinder 39 is so controlled, after passing over the top 26, that the roller 36 constantly presses over the top 26, that the roller 36 constantly presses against the last 2. In order that the roller 36 can effect a stretching of the upper, it is journalled with friction on the pin 37. As it advances along the upper 2, it constantly applies to the upper 2 a drafting force in a direction from the topline 28 to the lasting margin 3 by virtue of the friction existing between the roller 36 and upper 2.

The roller 36 is, like the tensioning strap 25, moved periodically to and fro, and indeed together with the operation of the side tack insertion device 5, so that, with reference to the co-operation of the friction closure element, shown by the roller 36, and side tack insertion device 5, reference can be made to the relevant explanations for FIGS. 1, 2 and 3. For completion, it should be also mentioned here that the roller 36 is moved without pressure by means of the piston-and-cylinder unit 39, when it is withdrawn relative to the lasting margin 3. This can be achieved by the piston-and-cylinder unit 39 being fully exhausted during the withdrawal or by the roller 36 being completely raised from the lasting margin 3.

It should be noted also that of course also in the embodiment according to FIG. 4 a pressure cushion can be provided after the style of the pressure cushion 35 according to FIGS. 1 and 3.

Figure 5:
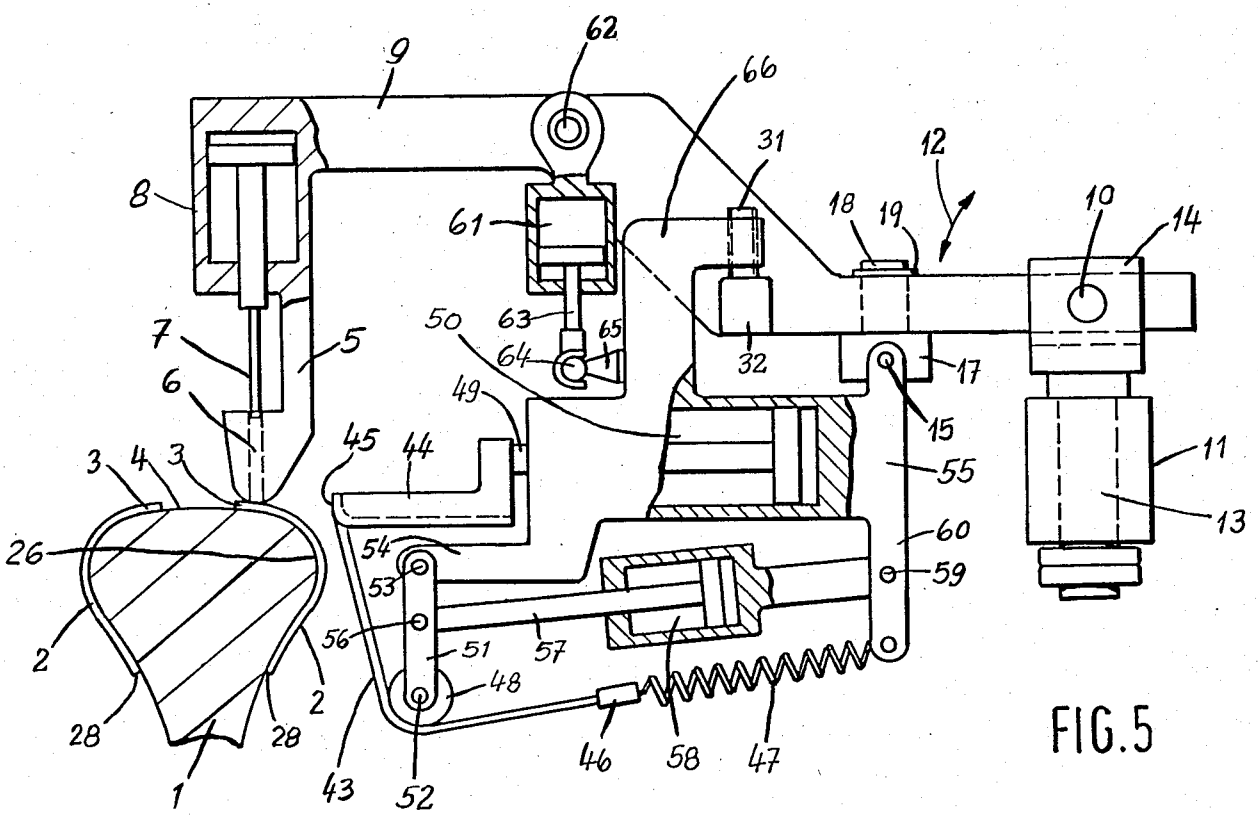
FIG. 5 shows the apparatus with tensioning strap and wiper.
Figures 6, 7:
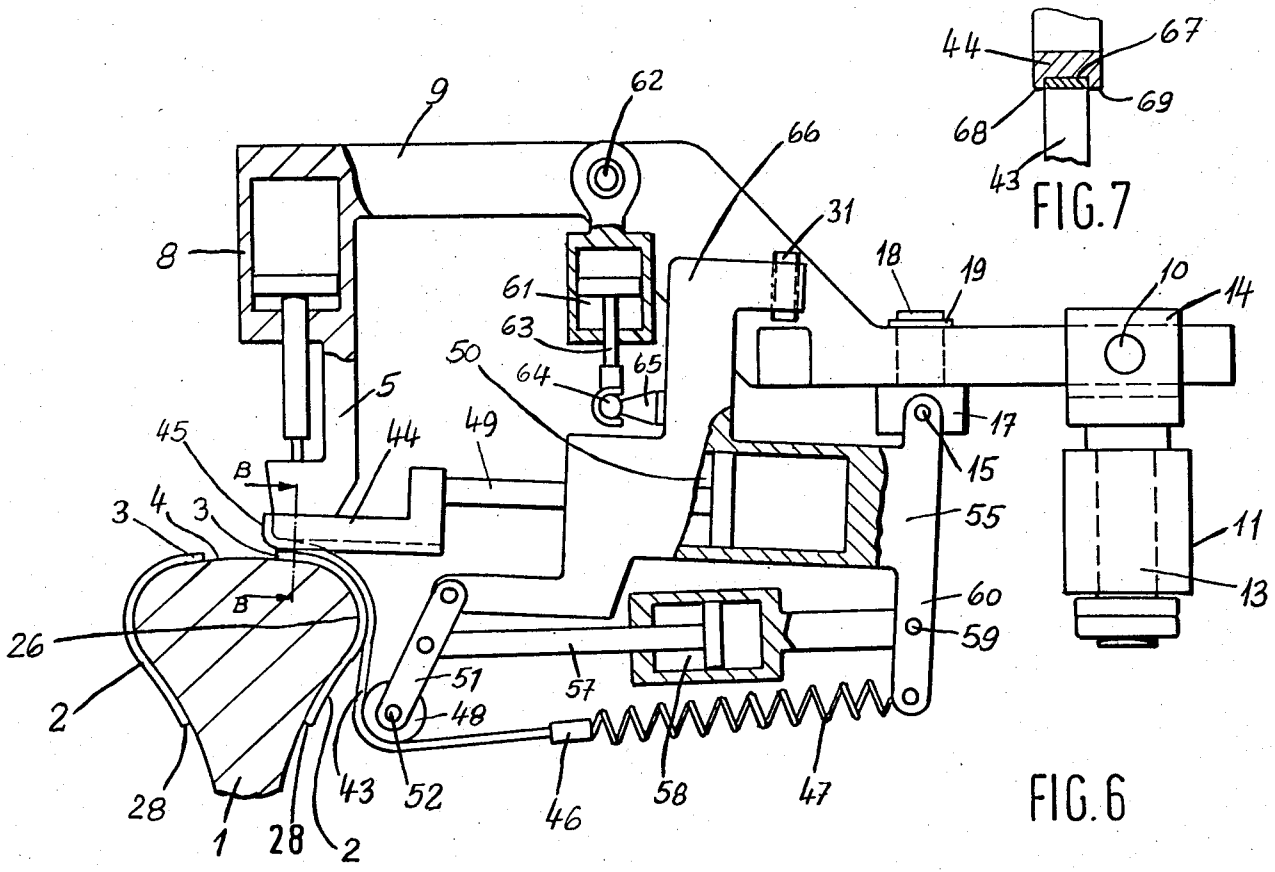
FIG. 6 shows the same apparatus with the tensioning strap applying pressure.
FIG. 7 shows a section along B—B of FIG. 6.

In FIGS. 5 and 6 is illustrated a further embodiment of the apparatus wherein the tensioning strap 43 together with the wiper 44 is used as the friction closure element. FIG. 5 shows the apparatus in its initial position, in which the tensioning strap 43 is held removed from the shoe upper 2. The apparatus is constructed similarly to that according to FIGS. 1 and 3, so that, with regard to the function of the side track insertion device 5, its mounting and guidance can be referred to the relevant explanations to FIGS. 1 and 3.

The tensioning strap 43 in this case is similarly mounted on two mounting points, namely the first mounting point 45 which is formed by the front end of the wiper 44, and the second mounting point 46, which forms the end of the tension spring 47. Between the two mounting points 45 and 46 the tensioning strap 43 is guided over the tensioning roller 48. The tensioning strap 43 in this case consists throughout of non-stretchable material, for example leather or textile material; its necessary yieldability is provided by the tension spring 47.

For stretching the shoe upper 2 the following operations take place. Starting from the position shown in FIG. 5 the wiper 44 and the tensioning roller 48 are moved in a direction towards the shoe upper 1. In this way the tensioning roller 48 first approaches the shoe upper 2 in order to bring the tensioning strap 43 first into touching contact with the shoe upper 2 in the region beneath the top 26. Then the approach of the wiper 44 to the region above the top 26 takes place, until the wiper finally assumes the position shown in FIG. 6. In this movement of the wiper 44, the tensioning strap 43 is drawn over the shoe upper 2, and indeed in a direction from the topline 28 to the lasting margin 3, whereby the necessary stretching of the shoe upper 2 takes place. In this movement of the tensioning strap 43, the latter is drawn over the roller 48, the tension spring 47 being correspondingly stretched.

In this embodiment a double effect is achieved in respect of the stretching of the shoe upper 2. On the one hand, the movement of the tensioning strap 43 along the shoe upper effects its stretching, and on the other hand the wiper 44 simultaneously effects an additional stretching in the region of the lasting margin 3, this latter being simultaneously pressed against the last bottom 4. In this way especially good preparations arise for the insertion operation of a tack. The wiper 44 and the tensioning roller 48 are, as in the previously described embodiments, actuated periodically together with the actuation of the side tack insertion device 5; thus they effect constantly a to-and-fro movement so that in this regard reference can be made to the explanations to FIGS. 1 and 3. In particular it should be pointed out that the tensioning strap 43 is so formed as is illustrated in FIG. 2.

The wiper is secured at the end of the piston rod 49 of the piston-and-cylinder unit, which is activated by a control. The tensioning roller 48 is pivotally journalled on the pin 52 at the end of the lever 51, the lever 51 being secured at its end away from the tensioning roller 48, by means of pin 53, on the extension 54 which projects from the holder 55. The lever 51 has, approximately in its middle, the pin 56 in which the piston rod 57 of the piston-and-cylinder unit 58 ends, which unit, with its end away from the pin 56, is pivoted by means of the pin 59 on the strut 60, which is a component part of the holder 55. By virtue of the actuation of the piston-and-cylinder unit 58, the lever 51 is caused to pivot about the pin 53, whereby the tensioning roller 48 is moved correspondingly therewith. Similarly to the embodiment in accordance with FIG. 4, the piston-and-cylinder unit 61 acts on the holder 55, said unit 61 being on the one had pivoted by means of the pin 62 on the carrier arm 9 and on the other acts via its piston rod 63 on the ball joint 64 which is secured on the angle 66 by means of the pin 65.

The angle 66 is a component part of the holder 55. By means of the piston-and-cylinder unit 61, the holder 55, and thus the wiper 44, are caused to be lowered and raised, the lowering movement being limited by the adjustment screw 31 and the projection 32 (see in this regard also the explanations to FIGS. 1 and 3). When the wiper 44 is advanced over the lasting margin 3, the piston-and-cylinder unit 61 is so actuated that the wiper thus presses against the lasting margin 3. When the wiper 44 is retracted, the piston-and-cylinder unit 61 is reversed and thus enables a pressure-less return of the wiper 44 relative to the lasting margin 3. In this return movement the wiper 44 can also be raised from the lasting margin 3.

The apparatus is shown in its operating position in FIG. 6, in which position the wiper 44 is disposed in its fully advanced position. In this position of the wiper the side tack insertion device 5 is then actuated, which drives in a tack. As can be seen, the adjusting screw 31 is somewhat raised from the projection 32, so that in this position of the wiper 44 the piston-and-cylinder unit 61 can apply its effect against the lasting margin 3 in respect of the application of pressure by the wiper 44.

The tensioning strap 43 is, as already previously mentioned, secured at the forward end of the wiper 44. In order that the tensioning strap is not exposed to any too strong load when wiping over the lasting margin 3, the tensioning strap is accommodated in the wiper 44 in the groove 67 seen in FIG. 7. FIG. 7 thus shows a section along the line B—B of FIG. 6, only the wiper 44 and the tensioning strap 43 being shown in FIG. 7, for reasons of clarity. When the wiper 44 engages the lasting margin 3, the tensioning strap 43 is pressed into the groove 67, the band 43 either disappearing fully into the groove 67 or only partially so according to the depth of the groove 67. This depends on the particular desired effect of the tensioning strap on the shoe upper 2. In the case of complete disappearance of the tensioning strap 43 in the groove 67, as shown in FIGS. 6 and 7, during wiping the two edges 68 and 69 of the wiper 44 substantially take over the pressing of the lasting margin 3 against the last bottom 4. As seen in FIG. 6, the groove 67 extends completely around the forward edge of the wiper 44, so that the tensioning strap 43 extends completely over this forward edge of the wiper 44. This makes clear the possibility of securing the tensioning strap 43 to the wiper 44 at this point, for example by a screw or rivets. It is of course also possible to loop the tensioning strap 43 completely around the forward edge of the wiper 44 and to secure it then from above to the wiper 44.

Figure 8:
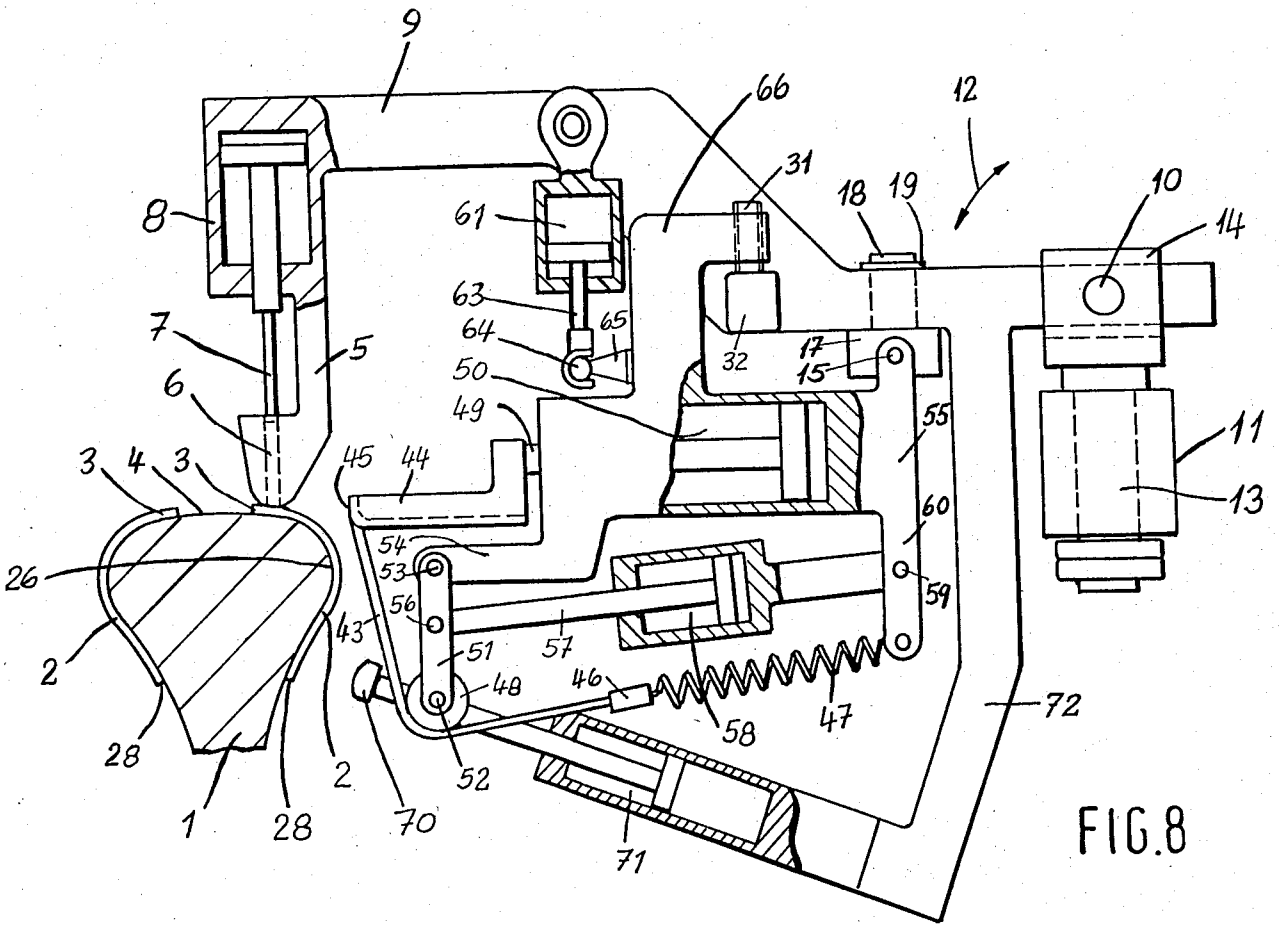
FIG. 8 shows a similar apparatus with pressure cushions.
Figure 9:
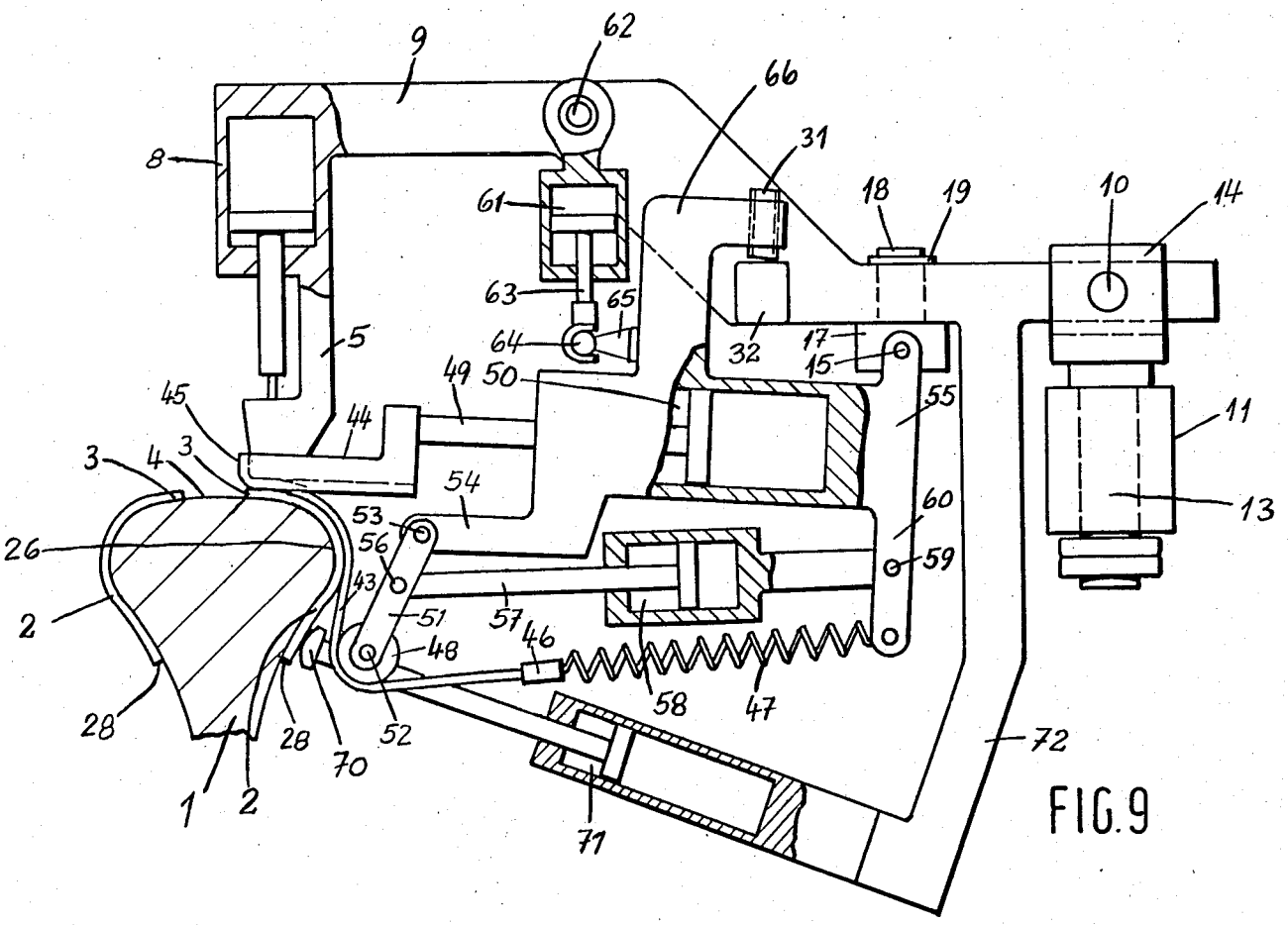
FIG. 9 shows the same apparatus with the tensioning strap and pressure cushions applying pressure.

In FIGS. 8 and 9 is shown an embodiment which is distinguished from the embodiment according to FIGS. 5, 6 and 7 only by the pressure cushion 70 additionally being provided, which cushion operates in the same way as the cushion 35 shown in FIGS. 1 and 3. With regard to its actuation in combination with the operation of the tensioning strap 43, therefore, reference can be made to the explanation to FIGS. 5, 6 and 7. The actuation of the pressure cushion 70 takes place in the embodiment according to FIGS. 8 and 9 by means of the piston-and-cylinder unit 71, which is mounted on the strut 72 fixed to the carrier arm 9.

Figure 10:
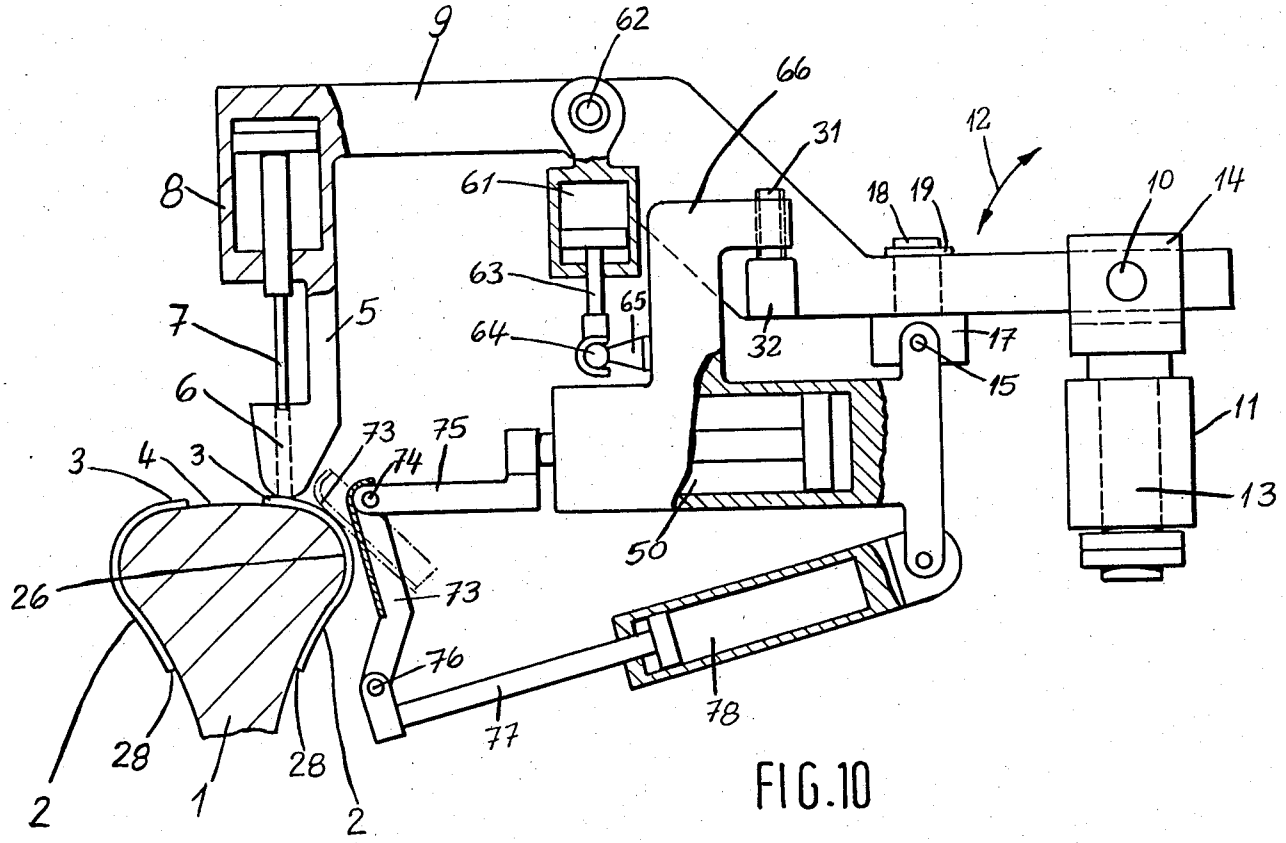
FIG. 10 shows an apparatus with a rolling runner constituting the friction closure element.
Figures 11, 12:
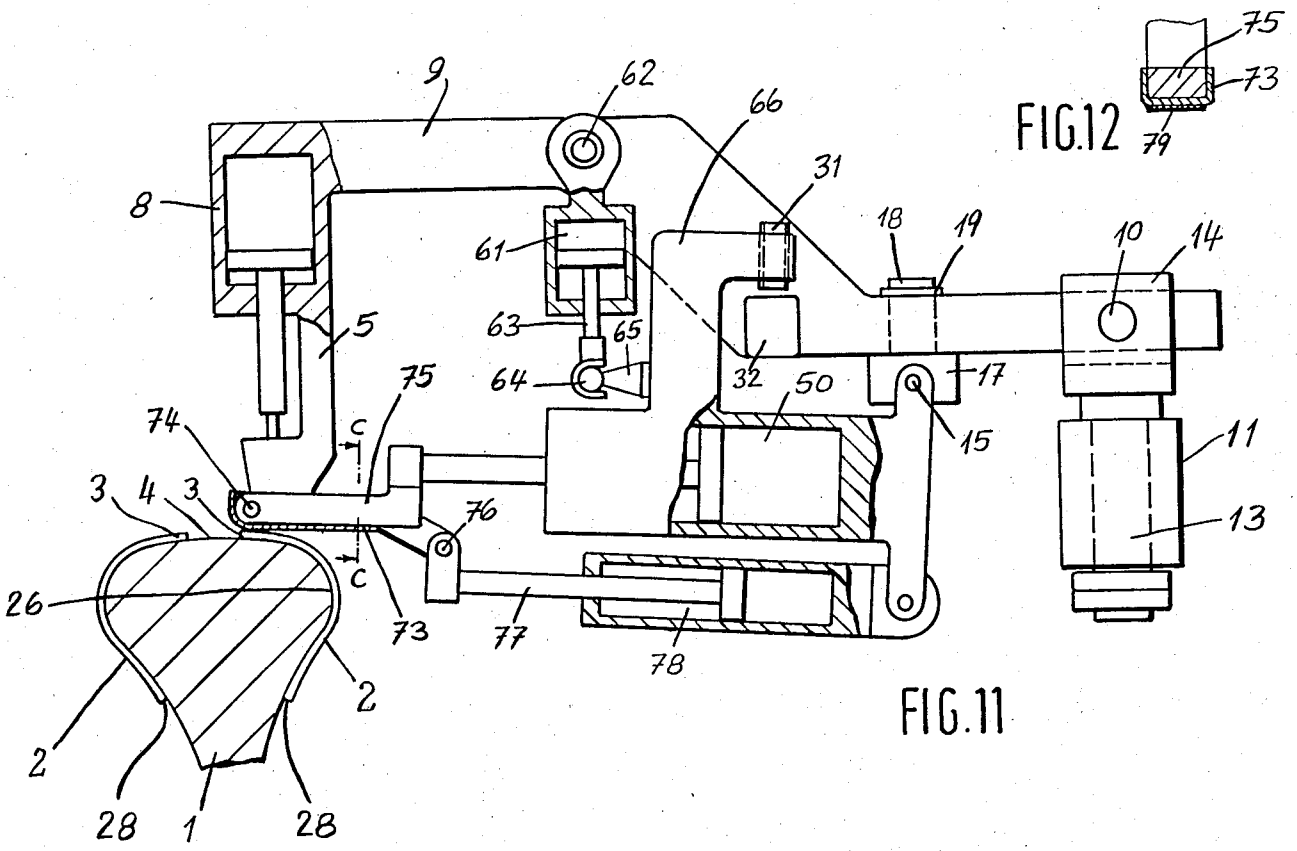
FIG. 11 shows the same apparatus with the rolling runner applying pressure.

In FIGS. 10 and 11 is shown a further embodiment wherein a smoothing runner is used as the friction closure element. The smoothing runner 73 is rotatably connected with its one end to the forward end of the wiper 75 by means of the axis 74, and is therefore correspondingly moved therewith, when the wiper 75 moves. The other end of the smoothing runner 73 is journalled on the pin 76 which is mounted at the end of the piston rod 77 of the piston-and-cylinder unit 78. Starting from the initial position of the smoothing runner 73 shown in FIG. 10, the runner is so moved by actuation of the piston-and-cylinder unit 50 for the wiper 75 and of the piston-and-cylinder unit 78 for the corresponding end of the smoothing runner 73, that it first engages the shoe upper 2 in the region of the top 26 of the last and then slidingly smooths over the shoe upper 2, the shoe upper 2 being stretched because of this sliding movement, until the smoothing runner 73 finally reaches its end position shown in FIG. 11, in which it lies parallel to the wiper 75. In this position the smoothing runner 73 has completely smoothed over the shoe upper 2. The smoothing runner 73 assumes the intermediate position shown in dotted line in FIG. 11. The smoothing runner 73 is provided with the friction coating 79 seen in FIG. 12 for the purpose of applying a certain friction to the shoe upper 2, FIG. 12 showing a section along the line C—C of FIG. 11. From FIG. 12 it is seen that the smoothing runner 73 embrasses the wiper 75 in the form of a U, for which reason it is shown in part section in FIGS. 10 and 11. Where the friction coating 79 is provided, it can be a matter of a vulcanised-on rubber coating.

With regard to other components of the apparatus in accordance with FIGS. 10 and 11, reference should be made to the explanations to the preceding Figures, especially to FIGS. 5 and 6. Also in the case of the embodiment according to FIGS. 10 and 11 the smoothing runner 73 effects a periodic to and fro movement, which is correspondingly matched to the actuation of the side tack insertion device 5, as described in connection with FIGS. 1 and 3.

With regard to the control of the embodiments shown in the drawings, it should be pointed out that it is a question of known techniques which are available in desired matter. The control is not the subject of the present invention, for which reason there is no description herein in detail. The necessary control sequences can be constructed in known matter as pneumatically actuated sequence controls; it is however also possible to provide an electronic control, for example with a microprocessor.

We claim:

1. A combined wiper and tack insertion device for a lasted shoe comprising a tack insertion device, an arm for carrying said tack insertion device, means for supporting said arm for horizontal movement along a selected path, clamp means for forcefully engaging and tensioning an upper to prepare the upper for tack insertion including a wiper assembly, a tensioning assembly, and housing means for supporting said wiper assembly and said tensioning assembly, said arm including means for supporting said housing means for rotation about a horizontal axis, means for forcefully biasing said housinig means from an elevated position towards a lowered position, said wiper assembly including wiper means displaceable with said housing means, and means for horizontally, forcefully displacing said wiper means from a retracted position to an advanced position, said tensioning assembly including a tension strap secured at one end to said wiper means and having an outer surface adapted to forcefully engage the lasted shoe, means for non-compressively engaging the inner surface of said tension strap, means for mounting said non-compressively engaging means on said housing means and means for pulling the other end of said tension strap.

2. A combined wiper and tack insertion device according to claim 1, wherein said non-compressively engaging means comprises roller means and wherein said means for mounting said roller means comprises lever means mounted for pivotal movement about one end and having said roller means mounted at the other end thereof and said tensioning assembly further comprises means connected to said lever means, intermediate the ends thereof, for displacing said lever and said roller from a retracted position to an advanced position.

* * * * *